US009056709B2

(12) United States Patent
Zhao

(10) Patent No.: US 9,056,709 B2
(45) Date of Patent: Jun. 16, 2015

(54) SIDE CONTAINER

(71) Applicant: Container Providers International APS, Copenhagen (DK)

(72) Inventor: Zhixiang Zhao, Jiangsu (CN)

(73) Assignee: Container Providers International APS, Copenhagen (DK)

( * ) Notice: Subject to any disclaimer, the term of this patent is extended or adjusted under 35 U.S.C. 154(b) by 16 days.

(21) Appl. No.: 13/973,529

(22) Filed: Aug. 22, 2013

(65) Prior Publication Data

US 2014/0166646 A1 Jun. 19, 2014

(30) Foreign Application Priority Data

Aug. 22, 2012 (CN) ..... 2012 2 0417716 U

(51) Int. Cl.
*B65D 88/12* (2006.01)
*B65D 88/10* (2006.01)

(52) U.S. Cl.
CPC ..... *B65D 88/127* (2013.01); *B65D 88/10* (2013.01); *B65D 88/12* (2013.01)

(58) Field of Classification Search
CPC ..... B65D 88/127
USPC ..... 220/1.5, 668, 4.01, 4.29, 604, 605, 606; 410/68, 52; 105/355, 404
See application file for complete search history.

(56) References Cited

U.S. PATENT DOCUMENTS

| | | | | |
|---|---|---|---|---|
| 3,765,556 | A * | 10/1973 | Baer | 220/1.5 |
| 4,057,170 | A * | 11/1977 | Dougherty | 220/323 |
| 7,971,713 | B2 | 7/2011 | Kim | |
| 7,984,819 | B1 | 7/2011 | Davis | |
| D651,500 | S | 1/2012 | Lancaster et al. | |
| 2001/0035410 | A1 | 11/2001 | Taube et al. | |
| 2007/0151971 | A1* | 7/2007 | Petzitillo et al. | 220/1.5 |
| 2009/0272738 | A1* | 11/2009 | Marcel | 220/1.5 |

* cited by examiner

*Primary Examiner* — Robert J Hicks
*Assistant Examiner* — Kareen Rush
(74) *Attorney, Agent, or Firm* — Andrew W. Chu; Craft Chu PLLC

(57) ABSTRACT

The side container includes one oblong under-frame; one oblong upper-frame; corner posts be installed on the four corners between under-frame and upper-frame; top surface panel, front end panel, back end panel and two side panels installed on the corner posts. The side panel has two side doors. At least one turnable locking bar should be installed on the upper area of the side door, and a latch hook should be installed on the bottom area of each locking bar. Cam keepers will be fixed on the under-frame. There is a cant hook installed between two permanent seats. When the under-frame is in a horizontal position, the cant hook is located above the latch hook. The side container can be fully open on an oblong side, while the side doors and the under-frame can still be securely locked, when the under-frame deforms downward during a full load condition.

4 Claims, 6 Drawing Sheets

SIDE CONTAINER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

This utility model refers to the technical field of shipping containers, in particular, full open side containers.

2. Description of Related Art Including Information Disclosed Under 37 CFR 1.97 and 37 CFR 1.98.

In present use, there is a comparable long shipping container is 20 feet long, the length being about 6 meters. The length of a 40 foot container is about 12 meters, because two side panels are fixed with the under-frame. The end door open structure is used to allow the under-frame enough strength and to increase the load weight capacity of the under-frame. Whereas, the end door open structure is quite inconvenient for loading and unloading. The full open side structure is needed. Containers with the full open side structure lack supporting strength. When in full load condition, the under-frame elastic deforms downward a lot. So, the container cannot lock with the normal locking mechanism. The container doors and the under-frame will not lock well.

SUMMARY OF THE INVENTION

The technical problem that this utility model aims to solve is to provide one type of a 40 foot full open side container which could be locked well between the container doors and the under-frame in a full load condition.

In order to solve the problem, this utility model adopts the follow technical precept: a 40 foot full open side door container, including one oblong under-frame; one oblong upper-frame; corner posts installed on four corners between under-frame and upper-frame; and a top surface panel, a front end panel, a back end panel and two side panels installed on the corner posts. The side panel should be comprised of two side doors at least. One side of the side door should be connected to the corner posts by hinges. At least one turnable locking bar should be installed on the vertical of the upper area of the side door. A latch hook should be installed on the bottom area of each locking bar. Cam keepers will be fixed on the under-frame with the same quantity as locking bars. The position of each cam keeper should match with the position of each latch hook. The cam keeper is comprised of two permanent seats and a cant hook installed between two permanent seats. The cant hook is vertically installed, and the length of the cant hook needs to be longer than the thickness of the latch hook, when the under-frame is in a horizontal position. The cant hook is located above the latch hook.

The locking bar is installed with the handle, and a lock catch is installed on the side doors. The position of the lock catch matches with the position of the handle.

The side panel is comprised of four side doors. Each of the two doors are combined, then the finished two combinations will be connected with hinges.

The structures of the hinges include the rotation axes installed in the corner posts. Junction plates are flexibly installed on the rotation axes, and the junction plates connect with the side doors.

The beneficial result is that the 40 foot full open side container achieves fully opened sides, while being securely locked between side doors and the under-frame, even when the under-frame has an elastic deformation downward in the full load condition.

Figure 1A:
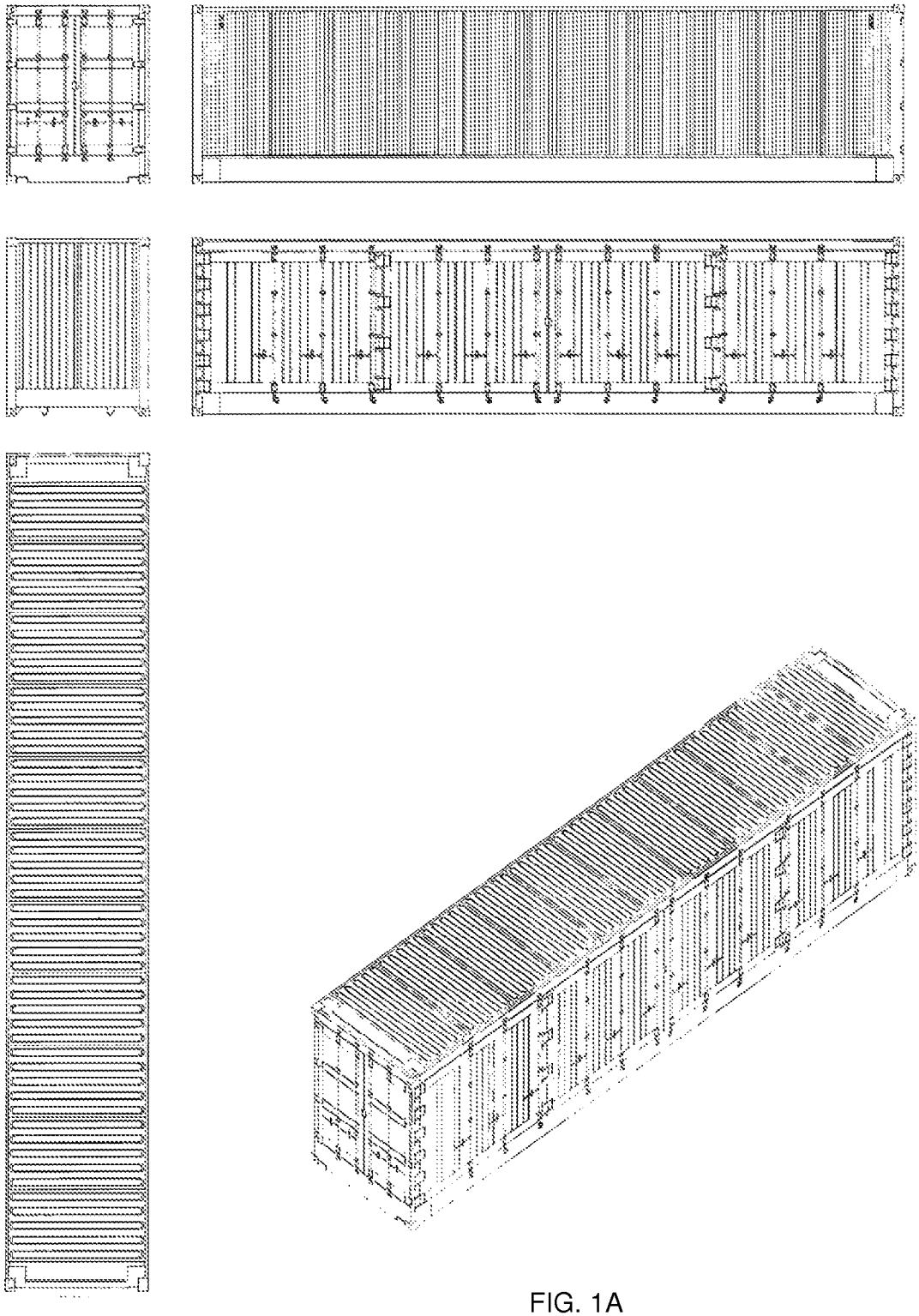
FIG. 1A is a series of front, side, back, and opposite side elevation views, a top plan view, and an upper perspective view.

In the Figures, the reference numerals are as follows: 1, under-frame, 2, upper-frame, 3, corner posts, 4, side doors, 5, hinges, 6, locking bar, 7, latch hook, 8, cam keeper, 9, permanent seats, 10, cant hook, 11, handles, 12, look catch, 13, rotation axes, 14, junction plates.

DETAILED DESCRIPTION OF THE DRAWINGS

The following practical case will provide more detailed description for this utility model.

Figure 1B:
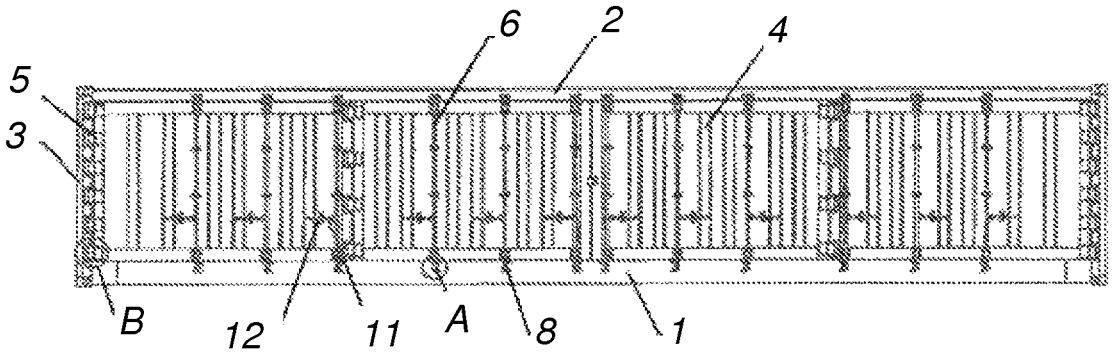
FIG. 1B is the side elevation view of the structure for this utility model.
Figure 2:
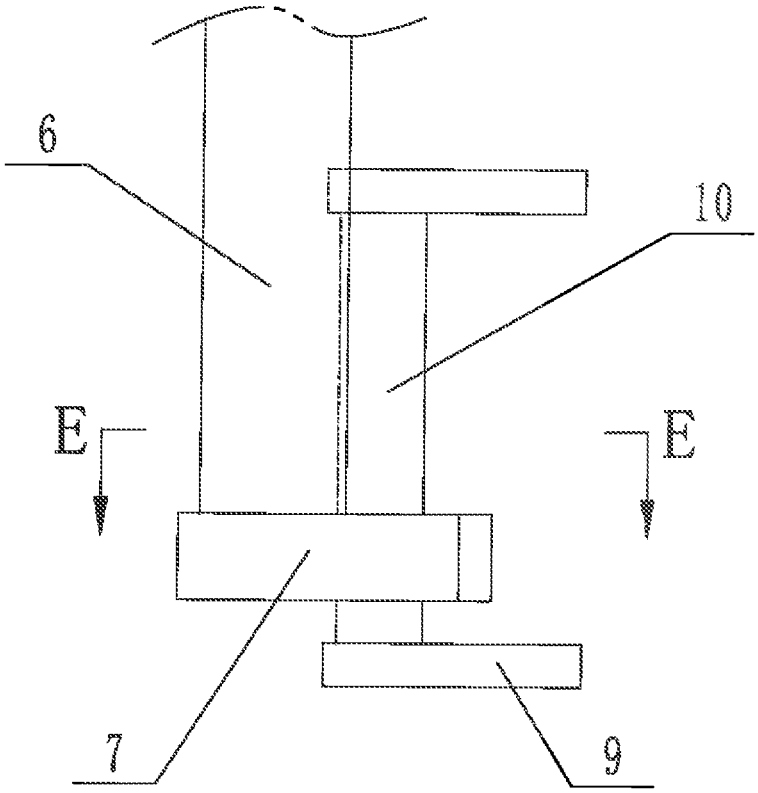
FIG. 2 is an enlarged schematic view of the structure for Part A in FIG. 1B.
Figure 3:
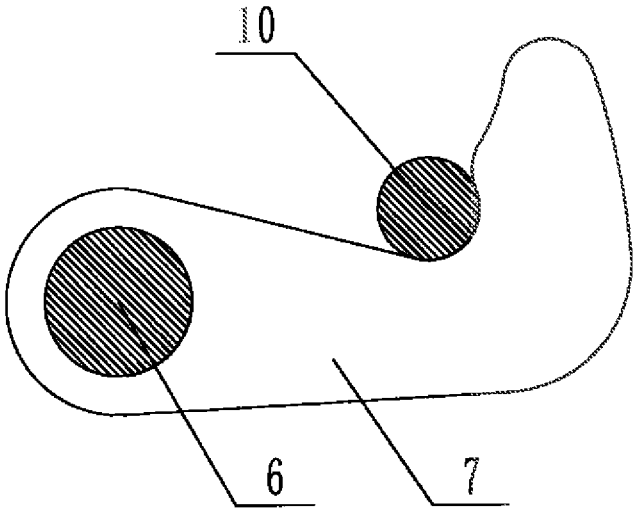
FIG. 3 is a cross-sectional view along line E-E of FIG. 2.

Showing in FIG. 1B, this 40 foot full open side container, includes one oblong under-frame 1, one oblong upper-frame 2, posts 3 installed separately on the under-frame 1 and four corners on the upper-frame 2, a top surface panel, front end panel, back end panel and two side panels installed on posts 3. The side panels should be comprised of two side doors 4 at least, and one side of the side doors 4 should be connected to the corner posts 3 by hinges 5. Just as FIGS. 2 and 3 show, at least one turnable locking bar 6 should be installed on the vertical of the upper area of the side door 4. The latch hook 7 should be installed on the bottom area of each locking bar 6, and cam keepers 8 will be fixed on the under-frame 1 with the same quantity as locking bars 6. The position of each cam keeper 8 should match with the position of each latch hook 7, and each cam keeper 8 is comprised of two permanent seats 9. The cant hook 10 is installed between two permanent seats 9 and is vertically installed. The length of the cant hook 10 needs to be longer than the thickness of the latch hook 7, when the under-frame 1 is in a horizontal position, and the cant hook 10 is located above the latch hook 7.

Being as a better precept, the locking bar 6 is installed with a handle 11, and a lock catch 12 is installed on the side doors 4, the position of the lock catch 12 matching with the position of the handle 11. When side doors 4 are in a locked condition, lock catch 12 could lock the handle 11 on the side doors 4 in case of handle 11 turning.

According to the present embodiments, the side panel is comprised of four side doors 4, wherein each of the two side doors 4 are combined, then the finished two side doors 4 will be connected with hinges 5.

Figure 4:
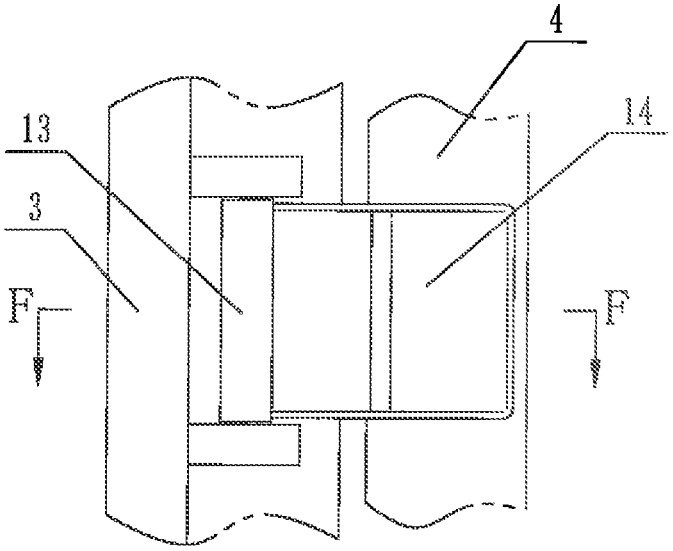
FIG. 4 is an enlarged schematic view of the structure for Part B in FIG. 1B.
Figure 5:
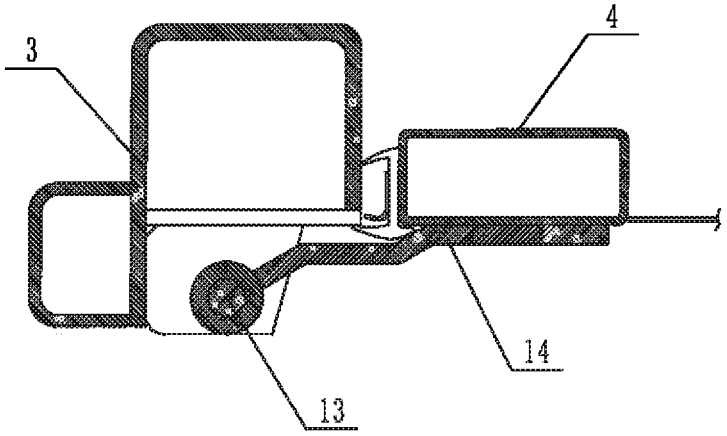
FIG. 5 is a cross-sectional view along line F-F direction in FIG. 4.

Being as a better precept, showing as FIGS. 4 and 5, the structures of the hinges 5 include the rotation axes 13 installed in the corner posts 3, junction plates 14 flexible installed on the rotation axes 13, the junction plates 14 being in connection with the side doors 4.

The 40 foot fully open side container adopts the fully opened side structure, when it needs to lock the side doors 4, turning the locking bar 6 to let the latch hook 7 hook the cant hook 10, so as to achieve the side doors 4 being locked. Also, when the under-frame 1 elastic deformation is downward during a full load condition, cam keeper 8 will move downward with the under-frame 1. The latch hook 7 could hook the upper area of the cant hook 10, and then it is still in a locked condition between side doors 4 and under-frame 1.

The above practical case only described the theories and the functions and the related functioned cases but not limit this utility model. It needs to be pointed out that, due to the normal technical stuff in this field, more deformations and promotions could be made out based on the creative design of this utility model, and they are all belong to the protect scope of this utility model.

The deformations create the domed and hollow portions and, hence to increase the strength of the T-shaped fitting, while preserving a constant thickness of the walls of the T-shaped fitting and, hence, without increasing its weight.

The length of 40 feet container is about 12 meters, because of the full open side structure, the under-frame is treated as a simple supported beam. The under-frame needs enough strength to support the load weight, so the height of the under-frame needs to increase for higher strength. Meanwhile, the inner space of the container should not be decreased while the under-frame is higher, or it will influence the needs for loading of container. Based on the above two points, choosing for this design, DOMEX steel was used in auto-ganged welding to form the special H steel section in making under-frame to achieve the requirements for high strength and small size.

The side comparative open structure could let a single door open to a rotary radius 6 meters. The torsion of the door plate is quite huge, so the special door plate and hinge structure protects the strength of the side door and rotates successfully.

By considering of the big elastic deformation of the container in full load condition, the locking mechanism of the lower part of the side doors is changed from traditional locking bar installation to the hook-type lock with a round bar cam keeper installation. It will leave enough activity space for a locking mechanism.

By considering of the damage and inconvenience, as it happens in loading big size cargos from the end door, the usage of fully opened side method will decrease the limitation of loading only from the end doors.

The invention claimed is:

1. A shipping container comprising:
one oblong underframe;
one oblong upper-frame;
corner posts installed on the four corners between said under-frame and said upper-frame;
top surface panel;
front end panel;
back end panel; and
two side panels installed on corner posts,
wherein at least one of said side panels is comprised of
two side doors, one side of at least one side door being connected to said corner posts by hinges,
at least one turnable locking bar installed on a vertical of an upper area of the side door,
a latch hook installed on a bottom area of each locking bar,
a cam keeper being comprised of two permanent seats, a position of each cam keeper matching a position of each latch hook, and
a cant hook installed between two permanent seats, said cant hook being vertically installed and having a length longer than a thickness of said latch hook,
wherein said cant hook is located above said latch hook when said under-frame is in a horizontal position.

2. The shipping container, according to claim 1, wherein said locking bar is installed with a handle, wherein a lock catch is installed on the side doors, and wherein a position of said lock catch matches a position of said handle.

3. The shipping container, according to claim 1, wherein said side panel is comprised of four side doors, two doors being combined in a combination, each combination being connected with hinges.

4. The shipping container, according to claim 1, wherein said hinges are comprised of rotation axes installed in said corner posts, and junction plates flexibly installed on said rotation axes, the junction plates connecting with the side doors.

* * * * *